US008953961B2

(12) United States Patent
Aoki

(10) Patent No.: US 8,953,961 B2
(45) Date of Patent: Feb. 10, 2015

(54) TONER ADHESION MEASURING DEVICE, TONER ADHESION MEASURING METHOD, AND IMAGE FORMING APPARATUS

(75) Inventor: Kunitoshi Aoki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 579 days.

(21) Appl. No.: 13/283,393

(22) Filed: Oct. 27, 2011

(65) Prior Publication Data

US 2012/0106997 A1 May 3, 2012

(30) Foreign Application Priority Data

Nov. 1, 2010 (JP) ..... 2010-245569
Oct. 25, 2011 (JP) ..... 2011-233887

(51) Int. Cl.
*G03G 15/00* (2006.01)

(52) U.S. Cl.
CPC ..... *G03G 15/5041* (2013.01); *G03G 15/5054* (2013.01); *G03G 15/5058* (2013.01)
USPC ..... 399/49

(58) Field of Classification Search
USPC ..... 399/49
See application file for complete search history.

(56) References Cited

U.S. PATENT DOCUMENTS 6,594,453 B2 * 7/2003 Kato ..... 399/49
7,190,912 B2 * 3/2007 Kato ..... 399/49
7,203,433 B2 * 4/2007 Kato et al. ..... 399/49
7,508,545 B2 * 3/2009 Ng et al. ..... 358/1.9
7,643,186 B2 * 1/2010 Hozono et al. ..... 358/504
7,680,425 B2 * 3/2010 Hama et al. ..... 399/49
7,973,952 B2 * 7/2011 Ono ..... 358/1.14
2002/0186980 A1 * 12/2002 Tsuruya et al. ..... 399/49
2003/0118361 A1 * 6/2003 Shimmura ..... 399/49
2004/0081476 A1 * 4/2004 Hama ..... 399/49
2006/0239704 A1 * 10/2006 Ishibashi ..... 399/49
2006/0239705 A1 * 10/2006 Ishibashi ..... 399/49
2007/0134014 A1 * 6/2007 Kato et al. ..... 399/49
2008/0056744 A1 * 3/2008 Takahashi ..... 399/49
2008/0089706 A1 * 4/2008 Nakazato et al. ..... 399/44
2008/0199194 A1 * 8/2008 Ishibashi ..... 399/49
2008/0232825 A1 * 9/2008 Komai ..... 399/9
2008/0253781 A1 * 10/2008 Takezawa ..... 399/39
2008/0253793 A1 * 10/2008 Ishibashi et al. ..... 399/74
2008/0273889 A1 * 11/2008 Kitazawa et al. ..... 399/58
2009/0190940 A1 * 7/2009 Miyadera ..... 399/39
2009/0196636 A1 * 8/2009 Miyadera ..... 399/39
2010/0021196 A1 * 1/2010 Atsumi et al. ..... 399/74
2010/0166443 A1 * 7/2010 Muto ..... 399/49
2010/0166445 A1 * 7/2010 Aoki ..... 399/53
2011/0102479 A1 * 5/2011 Kitada et al. ..... 345/690
2011/0158668 A1 * 6/2011 Fuse et al. ..... 399/49
2011/0182601 A1 * 7/2011 Nakatsuji et al. ..... 399/49

(Continued)

FOREIGN PATENT DOCUMENTS

JP 4-156479 A 5/1992
JP 8-327331 A 12/1996

*Primary Examiner* — David Bolduc
(74) *Attorney, Agent, or Firm* — Canon U.S.A., Inc., IP Division

(57) ABSTRACT

A device includes a laser source configured to irradiate a toner image on a bearing member with light, a base extracting unit configured to extract a base area of a reflection waveform of light reflected from the toner image irradiated by the laser source, and a toner adhesion computing unit configured to compute the amount of toner adhesion in the toner image in accordance with a change in position of the base area of the reflection waveform.

16 Claims, 12 Drawing Sheets

(56) References Cited

U.S. PATENT DOCUMENTS

2011/0188056 A1* 8/2011 Muto ..... 356/630
2011/0200347 A1* 8/2011 Hirobe ..... 399/49
2011/0293302 A1* 12/2011 Aoki ..... 399/49
2012/0002984 A1* 1/2012 Kawamoto et al. ..... 399/15

* cited by examiner

TONER ADHESION MEASURING DEVICE, TONER ADHESION MEASURING METHOD, AND IMAGE FORMING APPARATUS

BACKGROUND OF THE INVENTION

1. Field of the Invention

The present invention relates to a technique for measuring the amount of toner adhesion in a toner image formed on a bearing member of an image forming apparatus.

2. Description of the Related Art

Colors of images formed by an electrophotographic image forming apparatus vary with changes in various physical parameters, even if apparatus settings for image forming are unchanged. In particular, development and transfer processes typically contribute to variations in colors. This is because the amount of toner adhering to a photoconductive drum or a transfer belt is not stable, since environmental changes, such as changes in temperature and humidity, cause changes in latent image potential, the amount of toner supply, and transfer efficiency. Therefore, it is necessary to measure the amount of toner adhering to the photoconductive drum or transfer belt, control the amount of light exposure, development voltage, and transfer current in accordance with the measurement result, and thereby stabilize the development and transfer processes.

In general, such a control operation is performed when the printer environment changes, such as after replacing a toner cartridge, after printing a predetermined number of sheets, or after turning on the power of the printer main body. For measurement of the amount of toner adhesion, a plurality of toner patches with various densities (from low to high) are formed on the photoconductive drum or transfer belt. Then, after a toner adhesion measuring device measures the amount of toner adhesion in these toner patches, various control operations are performed under appropriate image forming conditions, in accordance with the measurement result.

Japanese Patent Laid-Open No. 8-327331 and Japanese Patent Laid-Open No. 4-156479 describe methods for measuring the amount of toner adhesion. Japanese Patent Laid-Open No. 8-327331 discloses a method in which the amount of light reflected from a bearing member irradiated with light and the amount of light reflected from a toner patch irradiated with light are detected, the amount of toner adhesion is measured from a difference between the detected amounts of reflected light, and image density parameters are controlled in accordance with the measurement result. Japanese Patent Laid-Open No. 4-156479 discloses a method in which the amount of toner adhesion is detected by measuring the thickness of a toner patch with a toner displacement gauge. In this method, an image bearing member and a toner image are irradiated with spot light, an image of reflected light is formed at a position corresponding to the thickness of the toner patch adhering to the image bearing member, the amount of toner adhesion is measured from a change in the position of the formed image, and image density parameters of the image pickup system are feedback-controlled on the basis of the measured thickness.

When the amount of toner adhesion is measured from the light reflection position, it is important to ensure that the surface of an object to be measured is optically uniform. That is, even if the same laser is used to irradiate the bearing member with spot light having the same power and diameter, micro-irregularities or scratches on the surface of the bearing member can cause uneven reflection within the spot, and can create distortion in the reflection waveform detected by an image pickup element. This makes it difficult to accurately detect the position of the reflection waveform and increases errors in measured values.

An actual waveform of laser light reflected from a bearing member is illustrated in FIG. 11. FIG. 11 illustrates a reflection waveform picked up by a line sensor. The irradiation of laser light originally has a bell-shaped distribution (Gaussian distribution) which is highest (brightest) at its center. However, in the example of FIG. 11, scratches on a belt surface cause unevenness in the amount of reflected light. As illustrated, the waveform has a bright line which rises sharply (due to a scratch) at a position to the right of the center. When performing detection of a center position of the reflected light using data of the entire spot, the line sensor determines, due to a significant effect of the bright line, that the center position is located to the right of the original center position of the laser spot. Therefore, a high toner height value is output as a detected value. Basically, a relative position of a scratch within a spot changes randomly depending on the installation of the sensor, fluctuations in the belt main scanning direction, and various types of mechanical vibration. Therefore, distortion of the picked-up waveform and the detected intensity values associated therewith are output as random noises that randomly change. In particular, when the scratch passes through the center of the spot, the scratch is intensely irradiated with the brightest light at the center. This tends to cause an increase in waveform distortion and error.

SUMMARY OF THE INVENTION

The present invention has been made in view of the problems described above. The present invention provides a technique in which a reflection position of reflected light is detected which is not dependent on surface conditions of an object to be measured so that accuracy in detecting the amount of toner adhering to the object to be measured is improved.

In an aspect of the present invention, a device that measures the amount of toner adhesion in a toner image formed on a bearing member of an electrophotographic image forming apparatus includes an irradiating unit configured to irradiate the toner image on the bearing member with light, a base extracting unit configured to extract a base area of a reflection waveform of light reflected from the toner image irradiated by the irradiating unit, and a toner adhesion computing unit configured to compute the amount of toner adhesion in the toner image in accordance with a change in position of the base area of the reflection waveform.

The present invention includes a method for measuring toner adhesion performed by the device, and the image forming apparatus including the device.

The present invention makes it possible to improve accuracy in detecting the amount of toner adhering to an object to be measured.

Further features of the present invention will become apparent from the following description of exemplary embodiments with reference to the attached drawings.

BRIEF DESCRIPTION OF THE DRAWINGS

The accompanying drawings, which are incorporated in and constitute a part of the specification, illustrate exemplary embodiments and features of the invention and, together with the description, serve to explain at least some of the principles of the invention.

DESCRIPTION OF THE EMBODIMENTS

Exemplary embodiments of the present invention will now be described in detail in accordance with the accompanying drawings.

A first embodiment describes a method in which a base area of a reflection waveform is optically extracted by saturating the output of a complementary metal oxide semiconductor (CMOS) line sensor, which is an image pickup element (image pickup unit).

Figure 1A:
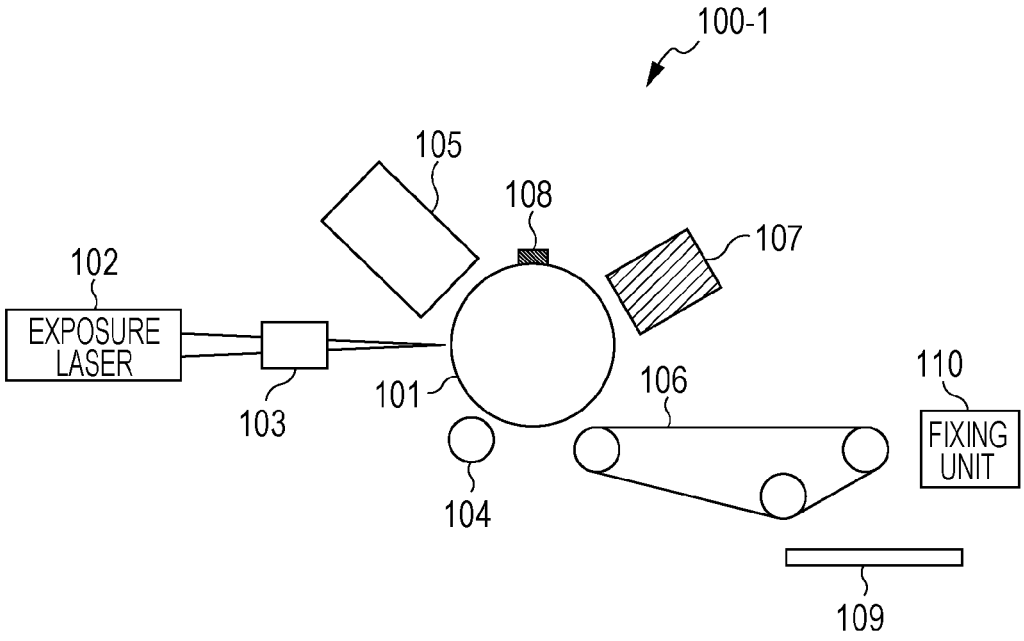
FIG. 1A and FIG. 1B are schematic diagrams each illustrating a configuration of an electrophotographic image forming apparatus according to a first embodiment.
Figure 1B:
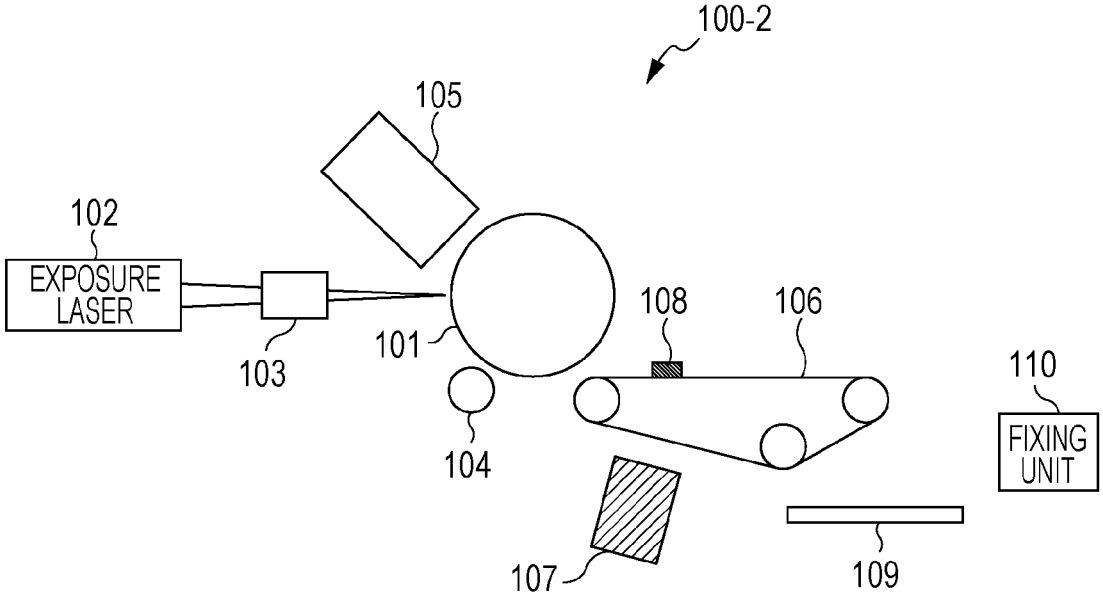

FIG. 1A and FIG. 1B are schematic diagrams each illustrating a configuration of an electrophotographic image forming apparatus according to the first embodiment.

An image forming apparatus 100-1 illustrated in FIG. 1A includes a photoconductive drum 101 serving as an image bearing member, an exposure laser 102, a polygonal mirror 103, a charging roller 104, a developing unit 105, a transfer belt 106, a toner adhesion measuring device 107, and a fixing unit 110.

In the image forming apparatus 100-1, first, the charging roller 104 charges a surface of the photoconductive drum 101, on which an electrostatic latent image is formed by the exposure laser 102 and the polygonal mirror 103. Next, in the image forming apparatus 100-1, the developing unit 105 forms a toner patch 108 on the photoconductive drum 101. Then, the toner adhesion measuring device 107 disposed downstream of the developing unit 105 measures the amount of toner adhesion in the toner patch 108. After the measurement of the amount of toner adhesion, the toner patch 108 is transferred to a print sheet 109, fixed by the fixing unit 110, and output as a printed material.

As in an image forming apparatus 100-2 illustrated in FIG. 1B, the amount of toner adhesion may be measured on the transfer belt 106 after the toner patch 108 is transferred from the photoconductive drum 101 to the transfer belt 106. Note that the toner adhesion measuring device 107 is an example of the application of a toner adhesion measuring device of the first embodiment.

Figure 2:
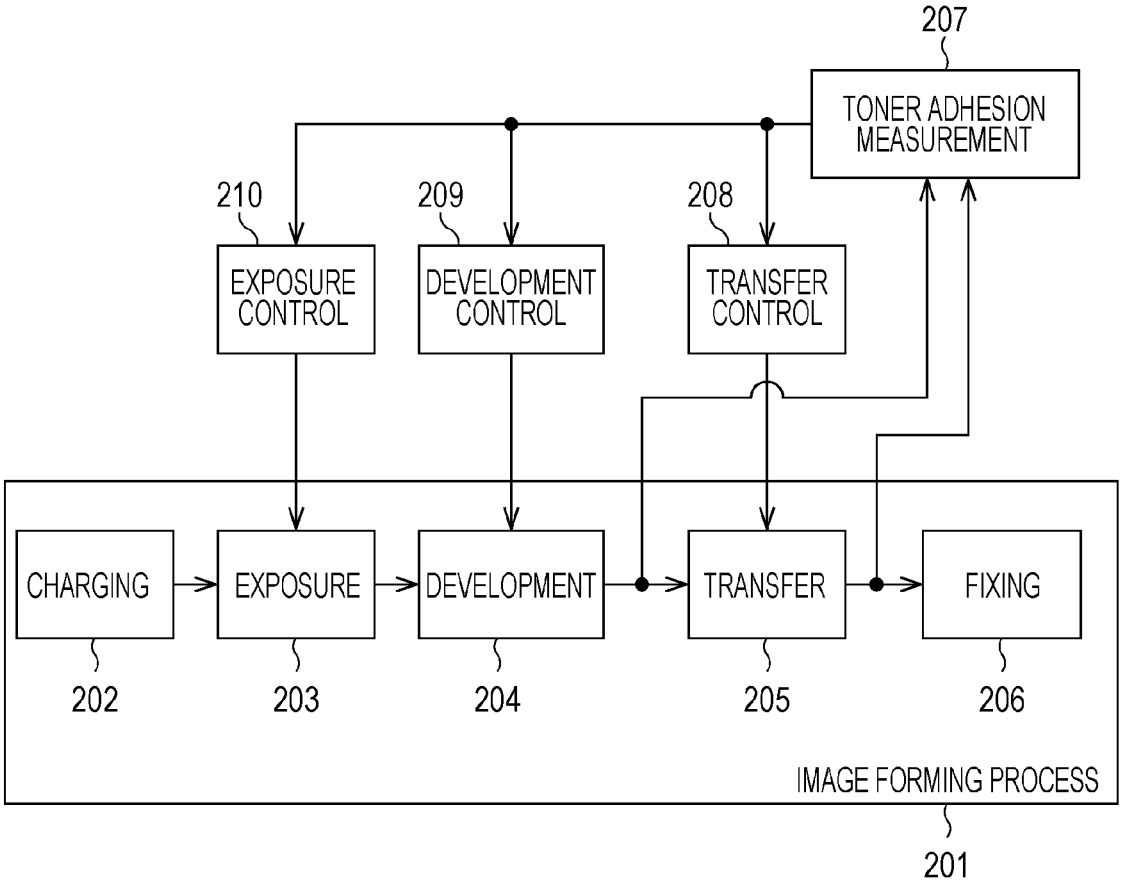
FIG. 2 is a control block diagram illustrating an example where an image forming process is controlled by a toner adhesion measurement according to the first embodiment.

FIG. 2 is a control block diagram illustrating an example where an image forming process 201 is controlled by a toner adhesion measurement 207 according to the first embodiment.

As illustrated, the image forming process 201 involves the following steps: charging 202, exposure 203, development 204, transfer 205, and fixing 206. The toner adhesion measurement 207 is carried out after the development 204 or the transfer 205. The amount of toner adhesion measured in the toner adhesion measurement 207 is fed back to transfer control 208, development control 209, and exposure control 210, which then control the corresponding steps. For example, in accordance with the amount of toner adhesion actually measured, the transfer control 208 corrects a transfer current in the transfer 205, the development control 209 corrects a developing bias voltage and the amount of toner supply in the development 204, and the exposure control 210 corrects a gradation γ characteristic in the exposure 203.

Figure 3:
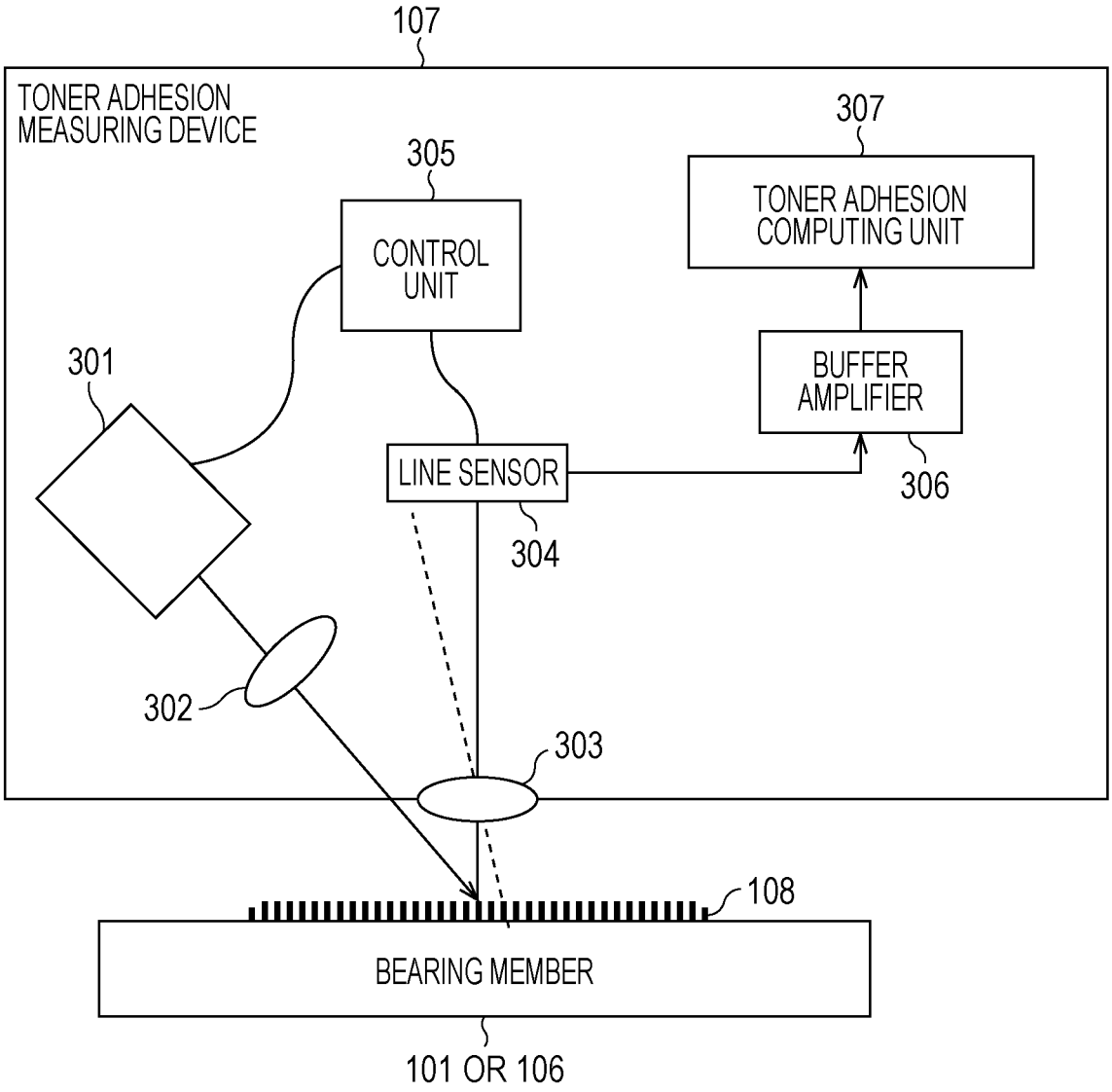
FIG. 3 is a schematic diagram illustrating a configuration of a toner adhesion measuring device according to the first embodiment.

FIG. 3 is a schematic diagram illustrating a configuration of the toner adhesion measuring device 107 according to the first embodiment.

The toner adhesion measuring device 107 includes a laser source 301 that irradiates the photoconductive drum 101 or the transfer belt 106 (hereinafter referred to as a "bearing member") and the toner patch 108 (toner image) with laser light, a condenser lens 302 that concentrates the laser light into a small spot, a light receiving lens 303 that forms an image of reflected light onto an image pickup element corresponding to the thickness of the toner patch 108, a line sensor 304 that picks up a reflection waveform of light formed into the image by the light receiving lens 303 as an electric signal, a control unit 305 that controls the laser source 301 and the line sensor 304, a buffer amplifier 306 that buffers an output waveform (reflection waveform) for the electric signal from the line sensor 304, and a toner adhesion computing unit 307 that calculates the amount of toner adhesion from a signal of the detected reflection waveform. That is, the toner adhesion measuring device 107 measures the amount of toner adhesion in a toner image formed on the bearing member of the electrophotographic image forming apparatus 100. Then, the image forming apparatus 100 performs color stabilization control on the basis of the amount of toner adhesion measured by the toner adhesion measuring device 107 (or specifically, the amount of toner adhesion calculated by the toner adhesion computing unit 307). In the first embodiment, the laser source 301 is an example of the application of an irradiating unit, the line sensor 304 and the control unit 305 are an example of the application of a base extracting unit, a drive unit that drives the bearing member is an example of the application of a scanning unit, and the line sensor 304 is an example of the application of an image pickup unit.

A procedure of measuring the amount of toner adhesion and reflection waveforms detected by the CMOS line sensor 304 will now be described with reference to FIG. 4A to FIG. 4D.

FIG. 4A to FIG. 4D are diagrams illustrating a procedure of measuring the amount of toner adhesion and reflection waveforms detected by the line sensor 304 according to the first embodiment.

Figure 4A:
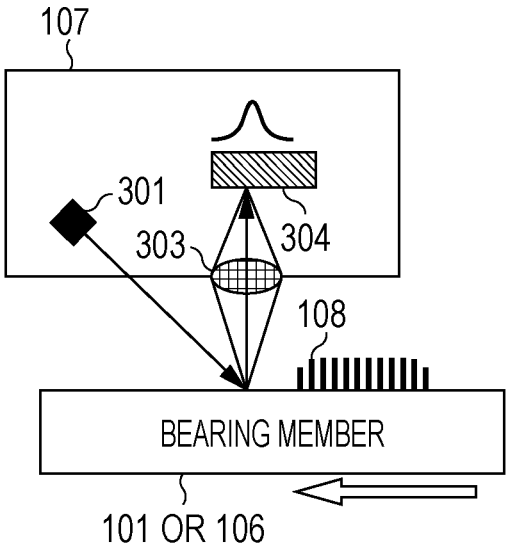
FIG. 4A to FIG. 4D are diagrams illustrating a procedure of measuring the amount of toner adhesion and reflection waveforms detected by a line sensor according to the first embodiment.

For measurement of the amount of toner adhesion, as illustrated in FIG. 4A, first, the bearing member 101 or 106 is irradiated with laser light on its surface where no toner patch 108 is present. Then, the line sensor 304 outputs a reflection waveform 401 (see FIG. 4C) of reflected light.

Figure 4C:
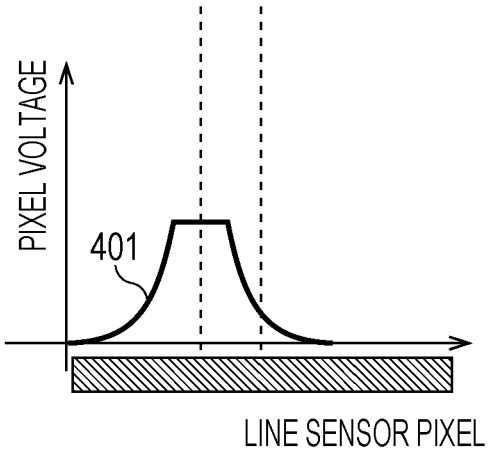
Figure 4B:
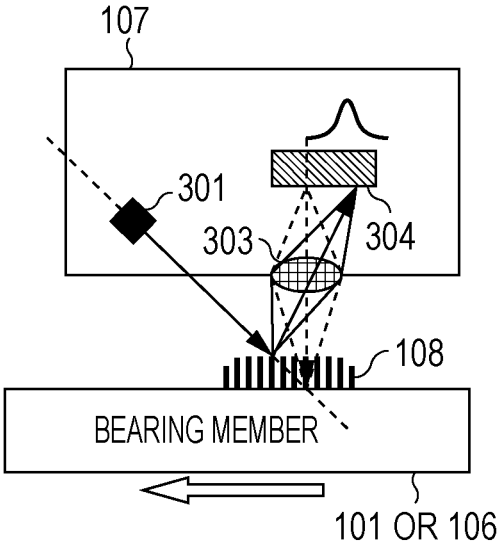

Next, as illustrated in FIG. 4B, the bearing member 101 or 106 is driven to move the point of laser irradiation to the toner patch 108. Then, the line sensor 304 detects a reflection waveform 402 (see FIG. 4D) of reflected light from the toner patch 108. The toner adhesion computing unit 307 performs signal processing (described below) on the reflection waveform data obtained from the bearing member 101 or 106 (reference point) and the toner patch 108 (the amount of change) on the bearing member 101 or 106, thereby calculating the amount of toner adhesion.

In the first embodiment, the control unit 305 controls the amount of irradiation from the laser source 301 and the light-receiving sensitivity or the accumulation time of the line sensor 304. A voltage that can be output from each pixel of the line sensor 304 is limited. If light having an intensity higher than a saturation level is incident on the pixel, or if light is accumulated in the pixel for a long time, the pixel voltage is limited to a saturation voltage level Vth or less.

Figure 5:
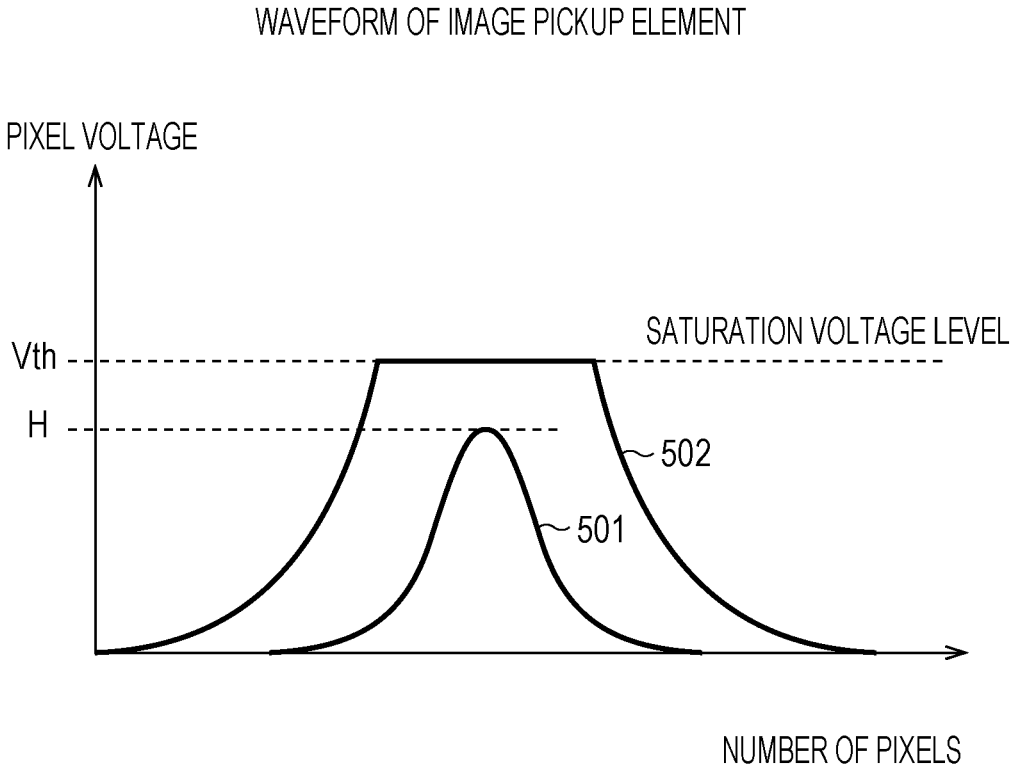
FIG. 5 is a diagram illustrating reflection waveforms according to the first embodiment.

FIG. 5 is a diagram illustrating reflection waveforms according to the first embodiment.

Typically, a waveform such as a waveform 501 of FIG. 5 is used, which is obtained by limiting conditions such that a signal voltage of a reflection waveform does not exceed the saturation voltage level Vth. However, in the first embodiment, control is performed such that a waveform such as a waveform 502 of FIG. 5 is output, which is obtained by clipping at a level near the peak. The height of the base area of the clipped waveform can be defined as 50% (FWHM) or 13.5% (1/e2) of the peak height of the waveform 501. For example, if the peak height of the waveform 501 is H and the clip height for base detection is defined as 13.5%, the base height can be expressed as 0.135H. This can be brought to the saturation voltage level Vth by multiplying, for example, the laser output, exposure time, or line sensor sensitivity by k=(Vth/0.135H). The waveform 502 contains little information about distortion at and around the peak caused by surface irregularities or scratches. Therefore, it is possible to suppress the effect of uneven reflection caused by scratches, and thus to accurately calculate the reflection position.

Figure 6:
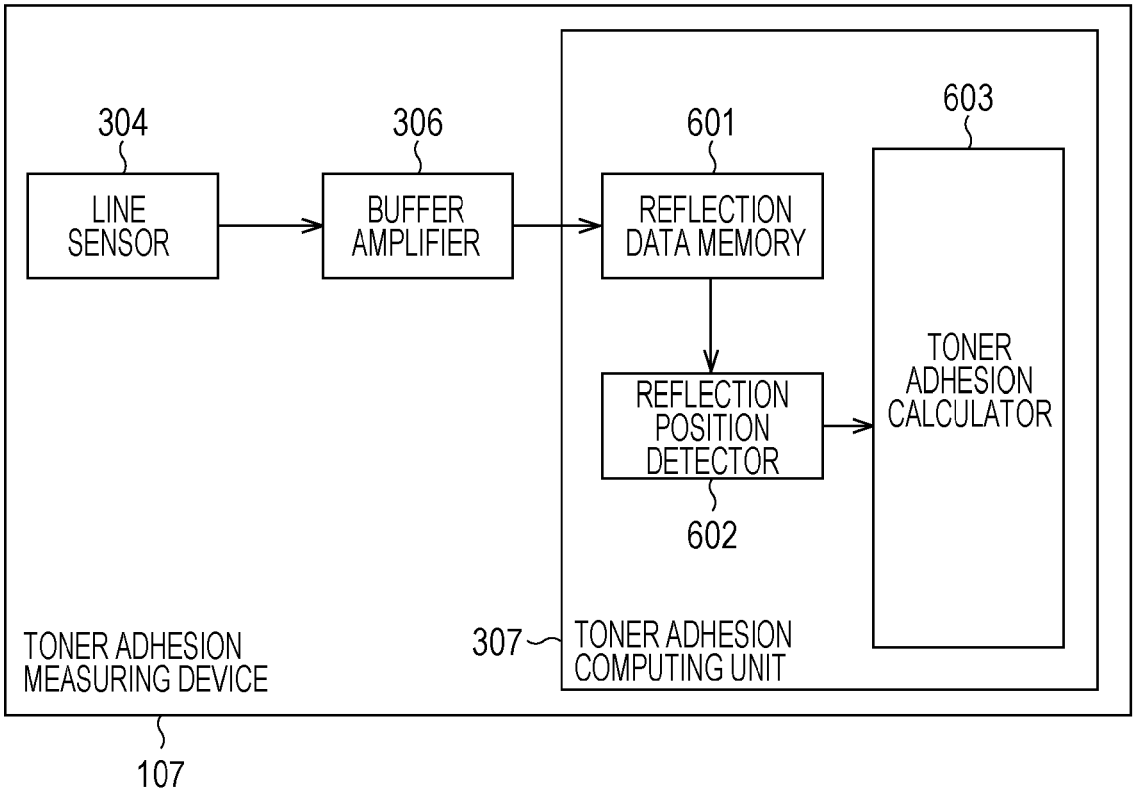
FIG. 6 is a block diagram illustrating an internal configuration of a toner adhesion computing unit of FIG. 3 according to the first embodiment.

FIG. 6 is a block diagram illustrating an internal configuration of the toner adhesion computing unit 307 of FIG. 3 according to the first embodiment.

As illustrated in FIG. 6, the toner adhesion computing unit 307 includes a reflection data memory 601, a reflection position detector 602, and a toner adhesion calculator 603. A process of computing the amount of toner adhesion will be described using the block diagram of FIG. 6.

Reflection data representing a waveform (reflection waveform) output from the line sensor 304 is impedance-adjusted by the buffer amplifier 306 and obtained by the toner adhesion computing unit 307. The obtained reflection data representing the reflection waveform is stored in the reflection data memory 601. The reflection position detector 602 detects the center of gravity of the reflection data stored in the reflection data memory 601 to detect a reflection position. The reflection position detector 602 calculates the center of gravity for the reflection waveform 401 in FIG. 4C and the reflection waveform 402 in FIG. 4D. Then, the reflection position detector 602 detects a displacement 403 in reflection position (see FIG. 4D) between the bearing member 101 or 106 and the toner patch 108. The reflection position detector 602 uses Equation (1) to calculate the center of gravity described above.

$$X_C = \frac{\sum x_i y_i}{\sum x_i} \qquad \text{Equation (1)}$$

Examples of methods other than calculating the center of gravity include fitting a waveform to a quadratic function (the following Equation (2)) to calculate a parameter B as a central value of the waveform. Other methods include simply detecting a central X coordinate of a flat portion of a clipped waveform without performing fitting.

$$f(x)=A(x-B)^2+c \qquad \text{Equation (2)}$$

The toner adhesion calculator 603 calculates a thickness h of the toner patch 108 from the displacement L (403) in reflection position obtained by the reflection position detector 602, an irradiation angle θ of the laser source 301, an optical magnification M of the light receiving lens 303, and a pixel pitch p of the line sensor 304. Then, the toner adhesion calculator 603 uses Equation (3) to calculate the amount of toner adhesion. That is, the toner adhesion computing unit 307 computes the amount of toner adhesion in a toner image in accordance with a change in position of a base area of a reflection waveform.

$$h = \frac{Lp}{M\tan\theta} \qquad \text{Equation (3)}$$

Figure 4D:
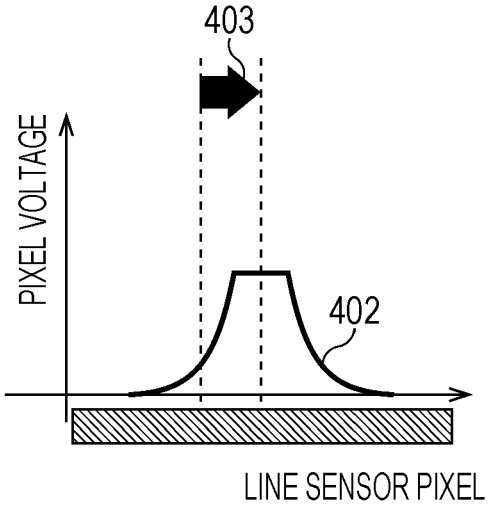

The reflection waveforms 401 and 402 illustrated in FIG. 4C and FIG. 4D may be measured multiple times to calculate the thickness h for each of the reflection waveforms 401 and 402 and determine an average height h' as the amount of toner adhesion. The amount of toner adhesion may be computed using Equation (3), or may be obtained using a lookup table (LUT) instead of Equation (3). In the first embodiment, determining the amount of toner adhesion on the basis of either Equation (3) or a lookup table is referred to as determining the amount of toner adhesion.

In the first embodiment, where a base area of a reflection waveform of reflected light from a toner image is extracted and a position of the extracted base area is detected, it is possible to detect a reflection position of reflected light which is less dependent on surface conditions of an object to be measured, and to reduce measurement error. It is thus possible to improve accuracy in detecting the amount of toner adhering to the object to be measured.

A method for measuring the amount of toner adhesion according to a second embodiment will now be described.

In the second embodiment, a method will be described in which a waveform is clipped by electrically limiting a waveform signal output from the CMOS line sensor, so as to extract a base area of the waveform. In the second embodiment, the same components as those in the first embodiment are given the same reference numerals and their detailed description will be omitted.

Figure 7:
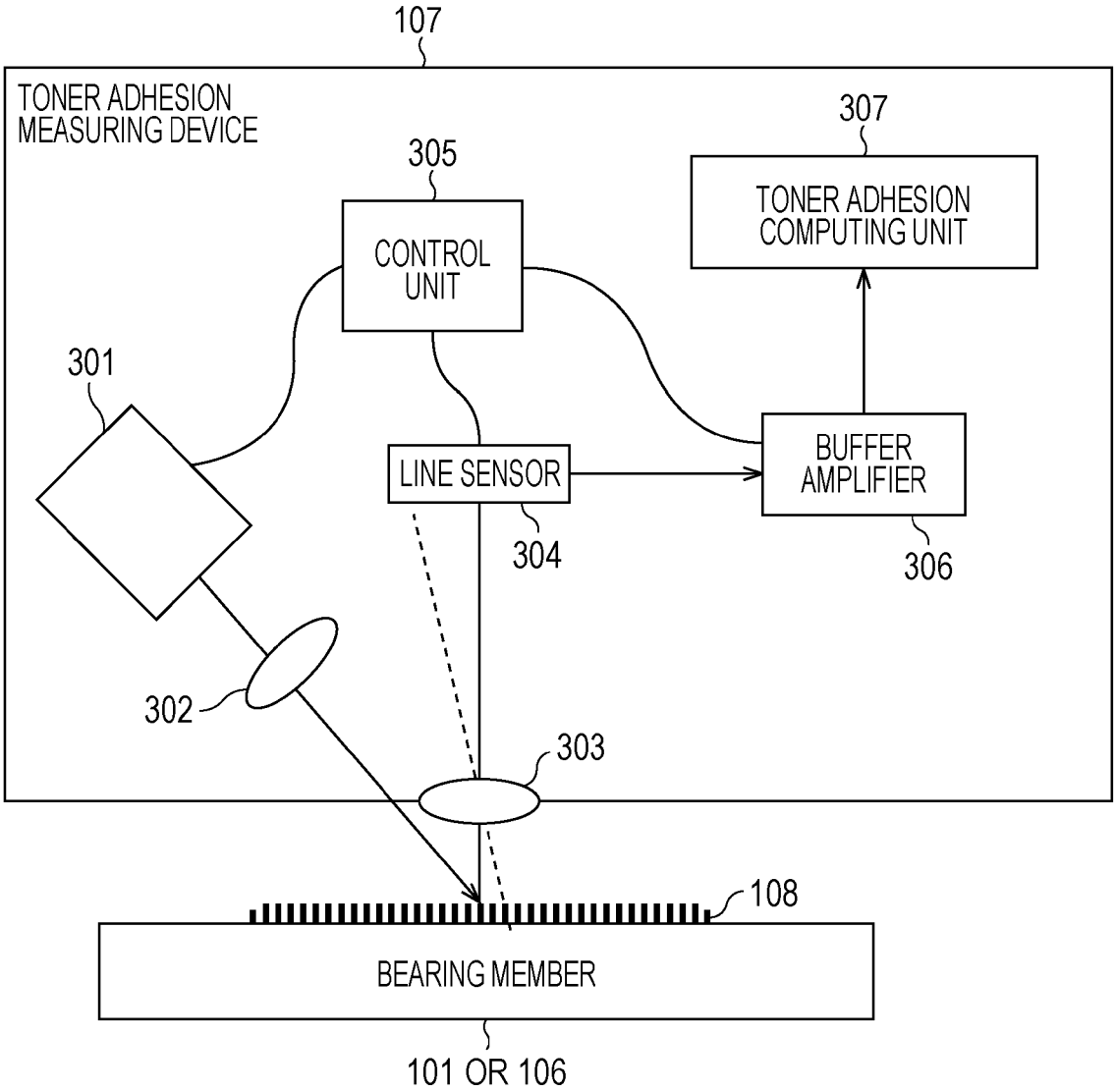
FIG. 7 is a schematic diagram illustrating a configuration of the toner adhesion measuring device according to a second embodiment.

FIG. 7 is a schematic diagram illustrating a configuration of the toner adhesion measuring device 107 according to the second embodiment.

As illustrated in FIG. 7, the control unit 305 of the toner adhesion measuring device 107 controls the laser source 301, the line sensor 304, and the buffer amplifier 306. The control unit 305 regulates the laser power of the laser source 301 and the light-receiving sensitivity or accumulation time of the line sensor 304, which picks up a waveform of reflected light. The picked-up waveform is impedance-adjusted by the buffer amplifier 306 downstream of the line sensor 304. The control unit 305 amplifies the input voltage waveform by setting a gain of the buffer amplifier 306 to a high level. Since the output voltage of the buffer amplifier 306 is limited to a predetermined value or less (Vo or less), the waveform can be clipped by setting a high degree of amplification. Then, for example, by calculating the center of gravity of the resulting base area of the waveform, the toner adhesion computing unit 307 can accurately determine the reflection position. Instead of amplification performed by the buffer amplifier 306 for clipping the waveform, a regulator or the like may limit the voltage to clip the waveform.

Figure 8:
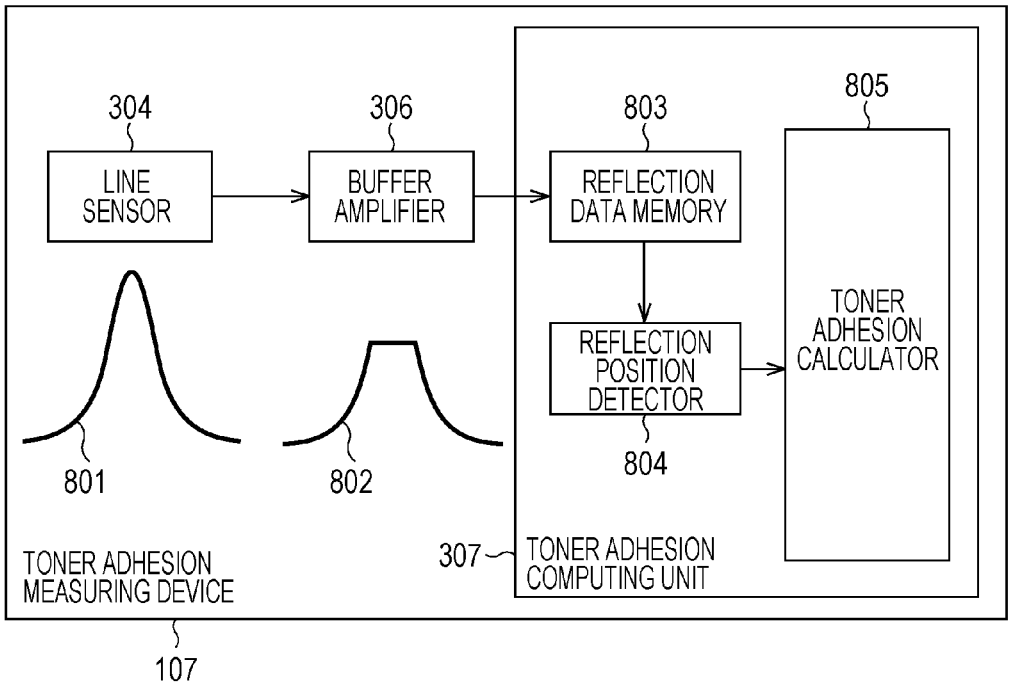
FIG. 8 is a block diagram illustrating an internal configuration of the toner adhesion computing unit of FIG. 3 according to the second embodiment.

FIG. 8 is a block diagram illustrating an internal configuration of the toner adhesion computing unit 307 of FIG. 3 according to the second embodiment.

As illustrated in FIG. 8, the toner adhesion computing unit 307 includes a reflection data memory 803, a reflection position detector 804, and a toner adhesion calculator 805.

The line sensor 304 outputs a waveform 801, which is output as a clipped waveform 802 from the buffer amplifier 306 by using a clamping voltage Vo of the buffer amplifier 306. The clipped waveform 802 is stored in the reflection data memory 803. The reflection position detector 804 detects a reflection position by calculating the center of gravity of the clipped waveform 802. In the second embodiment, the line sensor 304, the control unit 305, and the buffer amplifier 306 are an example of the application of a base extracting unit, and the buffer amplifier 306 is an example of the application of a limiting unit.

In the second embodiment, as in the first embodiment, the toner adhesion computing unit 307 calculates the amount of toner adhesion by performing signal processing on data of two reflection waveforms obtained from the bearing member (reference point) and the toner patch (the amount of change) on the bearing member.

A method for measuring the amount of toner adhesion according to a third embodiment will now be described.

In the third embodiment, a method will be described in which a voltage waveform output from the CMOS line sensor is clipped by signal processing, so as to detect a reflection position. In the third embodiment, the same components as those in the first and second embodiments are given the same reference numerals and their detailed description will be omitted.

Figure 9:
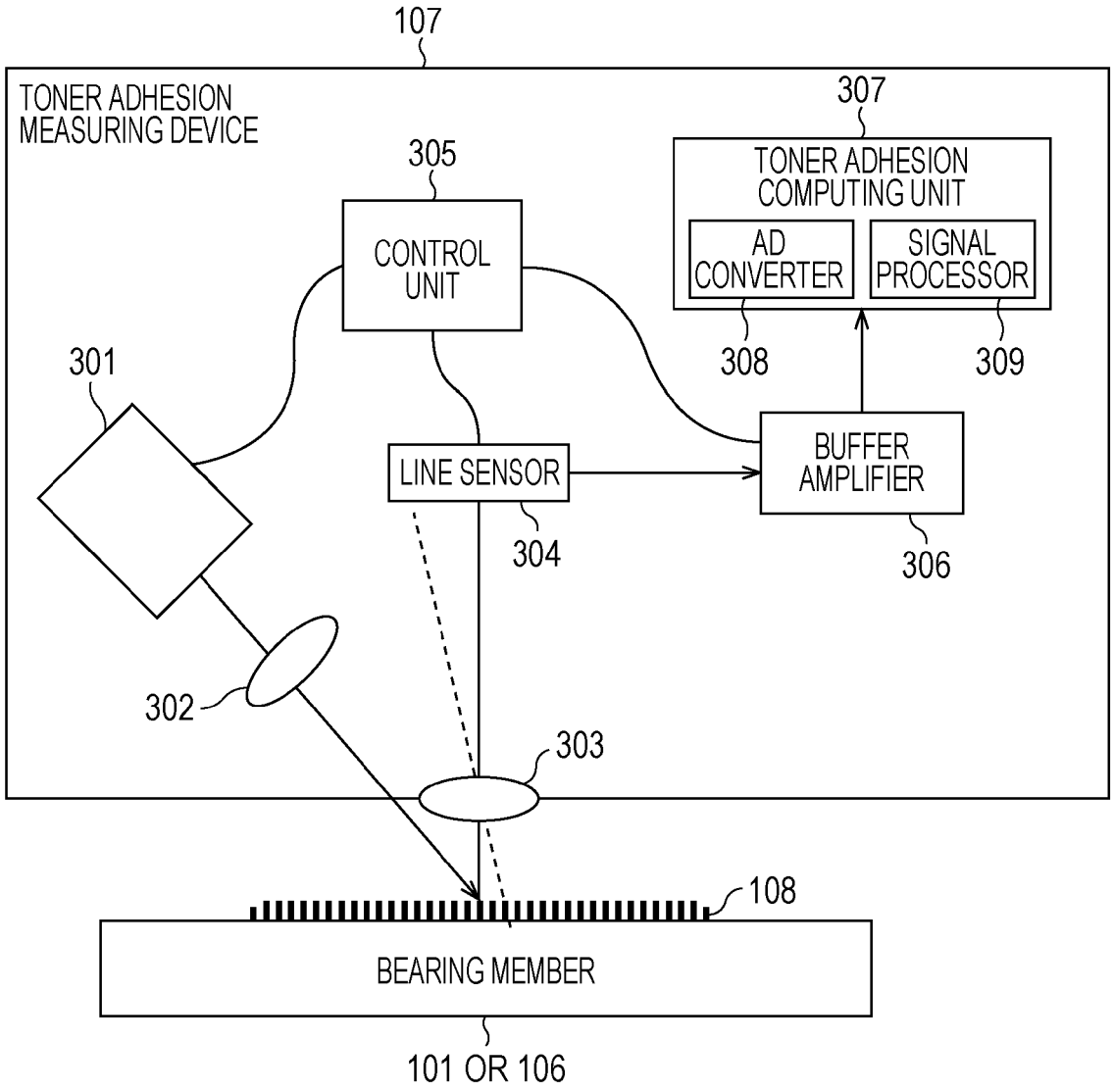
FIG. 9 is a schematic diagram illustrating a configuration of the toner adhesion measuring device according to a third embodiment.

FIG. 9 is a schematic diagram illustrating a configuration of the toner adhesion measuring device 107 according to the third embodiment. In the toner adhesion measuring device 107 of the third embodiment, the toner adhesion computing unit 307 includes an analog-to-digital (AD) converter 308 and a signal processor 309.

As illustrated in FIG. 9, a voltage waveform input through the line sensor 304 and the buffer amplifier 306 to the toner adhesion computing unit 307 is AD-converted by the AD converter 308 and recorded as data of a digital signal. In the third embodiment, a threshold value is set for the waveform data and a clipped waveform is calculated by computation (threshold processing). Specifically, the signal processor 309 processes the digital signal obtained by the AD converter 308 and extracts a base area of the reflection waveform. In the third embodiment, the line sensor 304, the control unit 305, the AD converter 308, and the signal processor 309 are an example of the application of a base extracting unit.

Figure 10A:
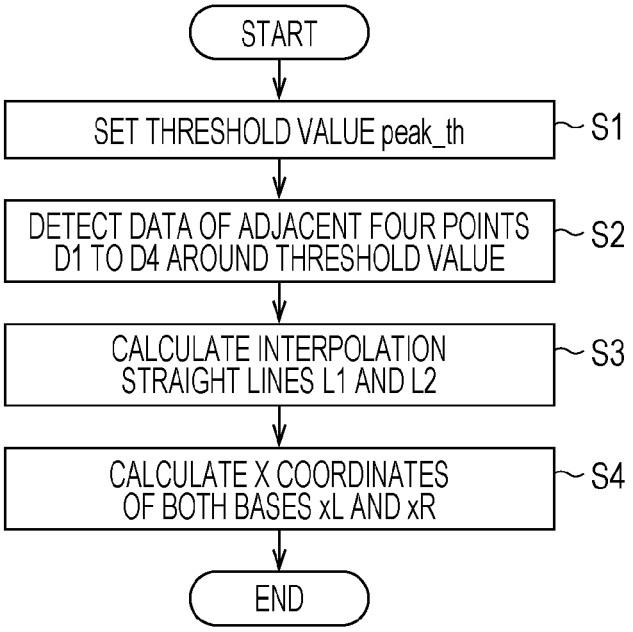
FIG. 10A is a flowchart illustrating a flow of specific signal processing performed in the toner adhesion measuring device according to the third embodiment.
Figure 10B:
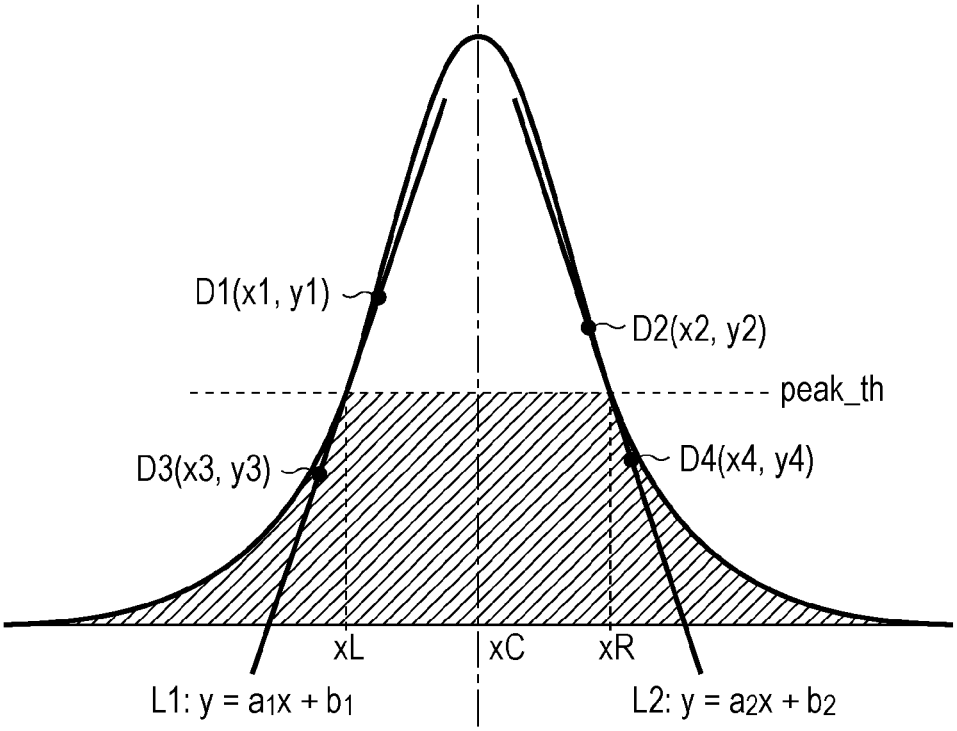
FIG. 10B is a waveform diagram corresponding to FIG. 10A.
Figure 11:
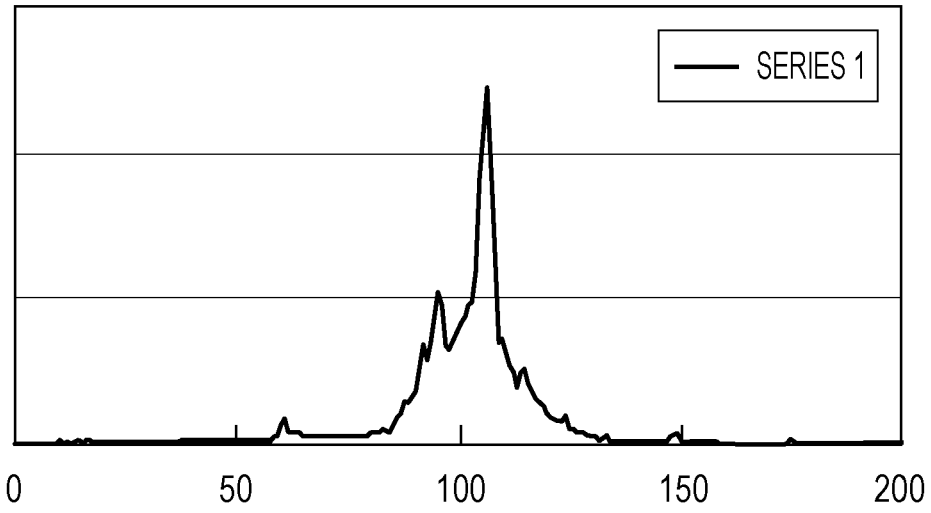
FIG. 11 illustrates a reflection waveform picked up by a line sensor.

FIG. 10A is a flowchart illustrating a flow of specific signal processing performed in the toner adhesion measuring device 107 according to the third embodiment. FIG. 10B is a waveform diagram corresponding to FIG. 10A.

For detecting a base area of a reflection waveform, in step S1 of FIG. 10A, the toner adhesion computing unit 307 sets a threshold value peak_th for an obtained waveform.

In step S2, the toner adhesion computing unit 307 detects data D1 to D4 (see FIG. 10B) of four points adjacent to each other around the threshold value peak_th set in step S1.

In step S3, for the data of two points on the left and right sides detected in step S2, the toner adhesion computing unit 307 calculates an equation y=ax+b for straight lines L1 and L2 each passing through the corresponding two points (see FIG. 10B).

In step S4, the toner adhesion computing unit 307 calculates X-coordinates xL and xR of intersections of the interpolation (approximate) straight lines L1 and L2 calculated in step S3 and the line indicating the threshold value peak_th set in step S1 (see FIG. 10B). The toner adhesion computing unit 307 uses the original waveform data, the X-coordinates xL and xR, and the threshold value peak_th to extract a shaded portion (base area) in FIG. 10B and calculate a reflection position from the center of gravity. The reflection position may be calculated by determining a central coordinate xC of the entire peak by averaging the X-coordinates xL and xR, which represent positional information of the peak base (see FIG. 10B).

In this example, a base area is discretely defined by using a specific threshold value at a level on the vertical axis of the waveform. Alternatively, a base area may be continuously defined by using a distribution where data at a lower level on the vertical axis is more dependent on various factors in positional detection.

A method for measuring the amount of toner adhesion according to a fourth embodiment will now be described.

In the fourth embodiment, a method will be described in which a voltage waveform (or signal waveform) output from the CMOS line sensor is clipped by signal processing, so as to detect a reflection position. In the fourth embodiment, the same components as those in the first, second, and third embodiments are given the same reference numerals and their detailed description will be omitted.

Figure 12A:
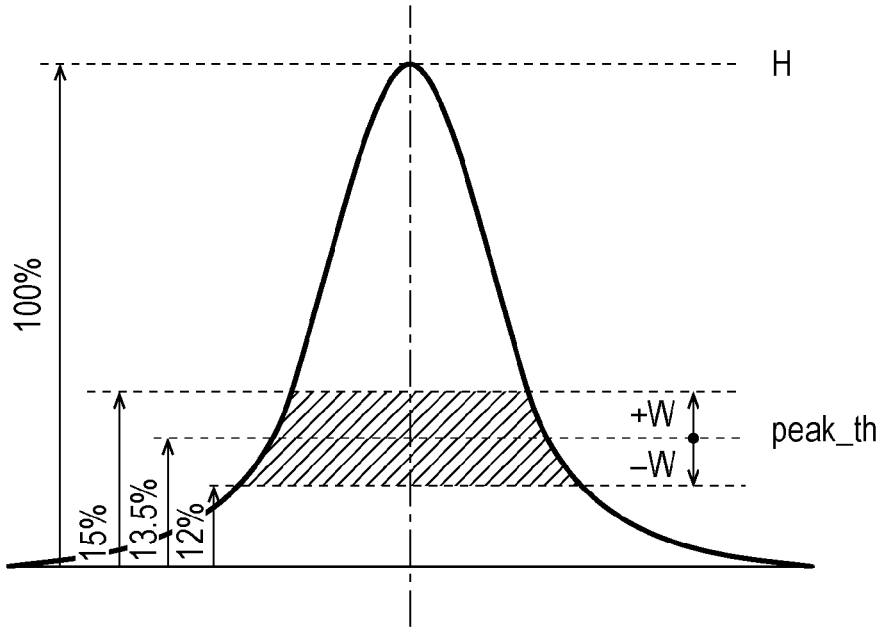
FIG. 12A and FIG. 12B are diagrams each illustrating a method for setting a threshold value when a base area is defined by signal processing according to a fourth embodiment.

FIG. 12A is a diagram illustrating a method for setting a threshold value when a base area is defined by signal processing according to the fourth embodiment. In the first embodiment, a base area is defined by only two points at 13.5% of the height of the peak signal H. In the fourth embodiment, however, a base area is defined by a region having a predetermined width centered at 13.5% (e.g., 12% to 15%). In other words, in the fourth embodiment, a base area is defined by a maximum value (15% of the height of the peak signal H) and a minimum value (12% of the height of the peak signal H).

Figure 12B:
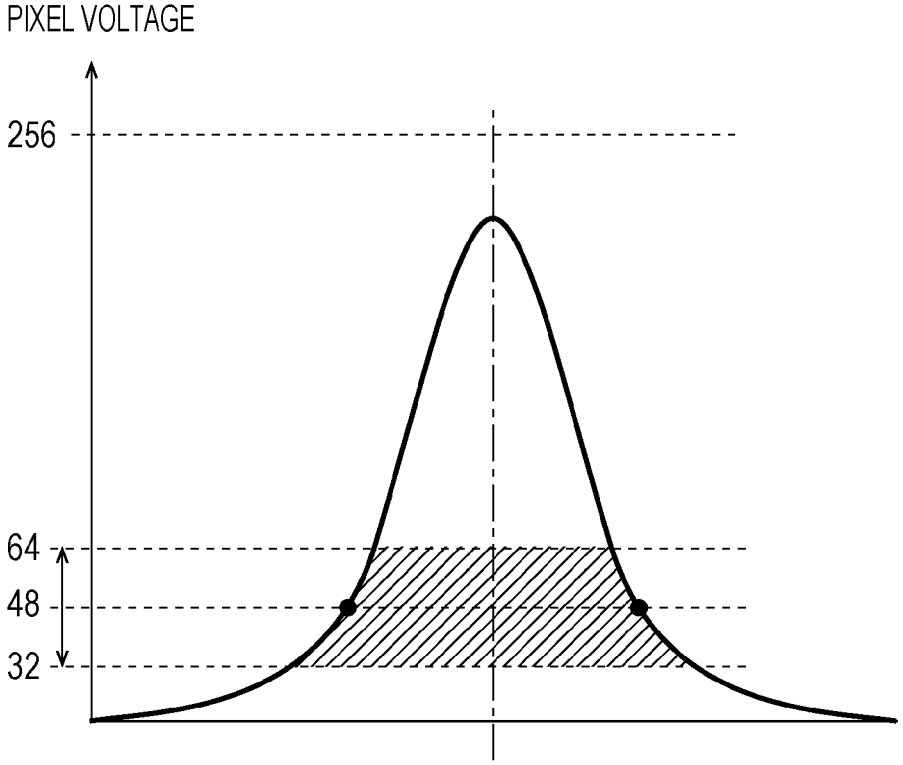

FIG. 12B is a diagram illustrating a method for setting a threshold value for an absolute value of an output value of the CMOS line sensor. If a pixel voltage (pixel signal) is saturated at 255 after conversion of an 8-bit AD converter (0 to 255), a base area is defined by setting a threshold value to 48 or a region ranging from 32 to 64. In other words, in the fourth embodiment, a base area is defined by a maximum value (pixel signal=64) and a minimum value (pixel signal=32).

The present invention is also realized by performing processing in which software (program) that implements the functions of the embodiments described above is supplied via a network or various storage media to a system or apparatus, and a computer (or a central processing unit (CPU), a microprocessing unit (MPU), or the like) of the system or apparatus reads and executes the program. The program and a computer-readable recording medium that stores the program are included in the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-245569 filed Nov. 1, 2010 and No. 2011-233887 filed Oct. 25, 2011, which are hereby incorporated by reference herein in their entirety.

What is claimed is:

1. A device that measures an amount of toner adhesion in a toner image formed on a bearing member of an image forming apparatus based on data obtained by a sensor that receives light reflected from the bearing member or the toner image, wherein the light is radiated from a light source to the bearing member or the toner image and is reflected by the bearing member or the toner image, the device comprising:

a control unit configured to control the light source or the sensor so that a peak of the light reflected from the toner image exceeds a predetermined value;

an obtaining unit configured to obtain reflection data which is a base waveform and is obtained by clipping the light reflected from the bearing member or the toner image at the predetermined value; and a toner adhesion determining unit configured to determine an amount of toner adhesion in the toner image in accordance with a change in position of the reflection data.

2. The device according to claim 1, wherein the change in position of the reflection data is a difference in position between reflection data to be obtained based on light radiated to and reflected from the toner image and reflection data to be obtained based on light radiated to and reflected from the bearing member.

3. The device according to claim 1, further comprising an irradiating unit configured to irradiate the toner image or the bearing member with light.

4. The device according to claim 1, wherein the obtaining unit obtains the reflection data by performing threshold processing on a waveform of the reflected light obtained from the sensor.

5. The device according to claim 4, wherein the threshold processing determines a threshold value based on a maximum value of the reflection waveform.

6. The device according to claim 1, wherein the control unit controls an output intensity or an exposure time of the light source so that a base waveform of the reflected light is received by the sensor.

7. The device according to claim 1, wherein the control unit limits a voltage of an electric signal converted by the sensor to a predetermined value or less to make the reflection waveform of the reflected light received by the sensor into the base waveform.

8. The device according to claim 1, wherein the obtaining unit comprises:

an image pickup unit that converts the reflection waveform to an electric signal;

an analog-to-digital converter that converts the electric signal obtained by the image pickup unit to a digital signal; and a signal processor that processes the digital signal obtained by the analog-to-digital converter and generates reflection data, which indicates the base waveform.

9. An image forming apparatus comprising the device according to claim 1, wherein color stabilization control is performed based on the amount of toner adhesion determined by the toner adhesion determining unit.

10. A method for measuring an amount of toner adhesion in a toner image formed on a bearing member of an image forming apparatus, the method comprising:

controlling a light source or a sensor so that a peak of light reflected from a toner image exceeds a predetermined value, wherein light is radiated from the light source to a bearing member or the toner image and is reflected by the bearing member or the toner image;

obtaining reflection data, which is a base waveform and is obtained by clipping the light reflected from the bearing member or the toner image at the predetermined value; and determining an amount of toner adhesion in the toner image in accordance with a change in position of the reflection data.

11. The method according to claim 10, wherein the change in position of the reflection data is a difference in position between reflection data to be obtained based on light radiated to and reflected from the toner image and reflection data to be obtained based on light radiated to and reflected from the bearing member.

12. A non-transitory computer readable storage medium that stores a program for having a computer execute a method for measuring an amount of toner adhesion in a toner image formed on a bearing member of an image forming apparatus, the method comprising:

controlling a light source or a sensor so that a peak of light reflected from a toner image exceeds a predetermined value, wherein light is radiated from the light source to a bearing member or the toner image and is reflected by the bearing member or the toner image;

obtaining reflection data, which is a base waveform and is obtained by clipping the light reflected from the bearing member or the toner image at the predetermined value; and determining an amount of toner adhesion in the toner image in accordance with a change in position of the reflection data.

13. The device according to claim 6, wherein the control unit performs control so that the light source radiates light of a higher intensity than a voltage level at which the sensor is capable of outputting a voltage.

14. The device according to claim 13, wherein the control unit performs control so that a peak of the reflection waveform is twice larger than the voltage level at which the sensor is capable of outputting a voltage.

15. The device according to claim 13, wherein the control unit performs control so that a peak of the reflection waveform is twice of $e^2$ larger than the voltage level at which the sensor is capable of outputting a voltage.

16. The device according to claim 8, wherein the obtaining unit sets a predetermined threshold for a reflection waveform indicated by the digital signal, detects data of adjacent four points near the predetermined threshold, calculates a first straight line passing through two points on a left side out of the four points and a second straight line passing through two points on a right side out of the four points, and calculates two x-coordinates at intersections of the first straight line, the second straight line and a line of the threshold as the reflection data indicating the base waveform.

* * * * *